US009962969B2

(12) United States Patent
Kato et al.

(10) Patent No.: US 9,962,969 B2
(45) Date of Patent: May 8, 2018

(54) RECORDING APPARATUS AND RECORDING METHOD

(71) Applicant: SEIKO EPSON CORPORATION, Tokyo (JP)

(72) Inventors: Junya Kato, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 14/963,640

(22) Filed: Dec. 9, 2015

(65) Prior Publication Data

US 2016/0167409 A1 Jun. 16, 2016

(30) Foreign Application Priority Data

Dec. 11, 2014 (JP) ..... 2014-250615

(51) Int. Cl.
*B41J 15/16* (2006.01)
*B65H 23/038* (2006.01)
*B41J 11/42* (2006.01)

(52) U.S. Cl.
CPC ..... *B41J 15/16* (2013.01); *B41J 11/42* (2013.01); *B65H 23/038* (2013.01); *B65H 2301/4493* (2013.01); *B65H 2404/113* (2013.01); *B65H 2404/143* (2013.01); *B65H 2513/106* (2013.01); *B65H 2553/41* (2013.01);
(Continued)

(58) Field of Classification Search
CPC ..... B65H 9/002
See application file for complete search history.

(56) References Cited

U.S. PATENT DOCUMENTS 5,947,617 A 9/1999 Kondo
2005/0175386 A1* 8/2005 Romine ..... B41J 11/0055 400/579

(Continued)

FOREIGN PATENT DOCUMENTS

GB 1584211 A * 2/1981 ..... B41J 15/04
JP 02249854 A * 10/1990

(Continued)

OTHER PUBLICATIONS

Machine generated English translation of JP 02-249854 to Sugawara, "Conveying Mechanism of Recording Medium Sheet"; generated via https://www.j-platpat.inpit.go.jp/web/all/top/BTmTopEnglishPage on Dec. 14, 2016; 3pp.*

*Primary Examiner* — Shelby Fidler
(74) *Attorney, Agent, or Firm* — Workman Nydegger

(57) ABSTRACT

A recording apparatus includes a transport unit capable of transporting a medium, a detection unit capable of detecting a transport direction in which the transport unit transports the medium, a recording unit capable of performing recording on the medium transported by the transport unit, and a plurality of rotating bodies provided in an intersecting direction that intersects the transport direction. Each rotating body is capable of contacting a side surface of the medium opposite to a recording surface of the medium on which recording is performed by the recording unit and has a rotation shaft that extends in the intersecting direction. The apparatus further includes a control unit that controls rotation speed of each rotating body individually on the basis of a result of detection by the detection unit.

8 Claims, 9 Drawing Sheets

(52) U.S. Cl.
CPC ..... *B65H 2601/272* (2013.01); *B65H 2701/1315* (2013.01); *B65H 2801/36* (2013.01)

(56) References Cited

U.S. PATENT DOCUMENTS

| | | | | |
|---|---|---|---|---|
| 2009/0096155 | A1* | 4/2009 | Deckard ..... | B65H 9/002 271/228 |
| 2013/0286072 | A1* | 10/2013 | Armbruster ..... | B41J 15/046 347/14 |
| 2016/0023858 | A1* | 1/2016 | Mizuno ..... | B65H 9/002 271/228 |

FOREIGN PATENT DOCUMENTS

| | | | |
|---|---|---|---|
| JP | 09-3008883 | A | 11/1997 |
| JP | 10-129896 | A | 5/1998 |
| JP | 2003-146484 | A | 5/2003 |

* cited by examiner

RECORDING APPARATUS AND RECORDING METHOD

BACKGROUND

1. Technical Field

The present invention relates to a recording apparatus and a recording method.

2. Related Art

Recording apparatuses that transport a medium and perform recording on the transported medium have been used. If in such a recording apparatus, a medium is skew-transported, there arises a risk that the quality of a recorded image may decline or a risk that the medium may wrinkle and contact a recording unit so that a recorded image, the medium, the recording unit, etc. will be damaged. Therefore, technologies intended to inhibit skew transport of a medium have been proposed.

For example, JP-A-2003-146484 discloses a transport apparatus in which two rollers arranged in a direction intersecting the transport direction of a cut sheet-shaped medium are placed in contact with the upper surface of the medium and the driving of one of the rollers is stopped so that a transport speed of the medium can be changed.

However, since the transport apparatus of JP-A-2003-146484 configured so that the two rollers are in contact with an upper surface of a medium, use of the transport apparatus in a recording apparatus results in the two rollers contacting the recording surface of a medium, giving rise to a risk that the rollers may damage the recording surface. Furthermore, because the transport apparatus is configured to determine the skew of a medium by detecting a leading end of the medium, the apparatus cannot be applied to a continuous medium such as a rolled medium, that is, the kinds of media to which the transport apparatus is applicable are limited.

Thus, in the related-art recording apparatuses that transport a medium and perform recording on the medium, there are cases where it is difficult to inhibit the skew transport of a medium.

SUMMARY

An advantageous effect of some aspects of the invention is that the skew transport of a medium can be inhibited.

A recording apparatus according to a first aspect of the invention includes a transport unit capable of transporting a medium, a detection unit capable of detecting a transport direction in which the transport unit transports the medium, a recording unit capable of performing recording on the medium transported by the transport unit, and a plurality of rotating bodies provided in an intersecting direction that intersects the transport direction. Each rotating body is capable of contacting a side surface of the medium opposite to a recording surface of the medium on which recording is performed by the recording unit and has a rotation shaft that extends in the intersecting direction. The recording apparatus also includes a control unit that controls rotation speed of each rotating body individually on the basis of a result of detection by the detection unit.

The foregoing recording apparatus may further include a mobile body that moves in the intersecting direction together with the recording unit, and the detection unit may be provided on the mobile body.

In the foregoing recording apparatus, the detection unit may be provided upstream of the recording unit in the transport direction.

The foregoing recording apparatus may further include a take-up unit provided downstream of the recording unit in the transport direction and being capable of taking up the medium, and the detection unit may be provided in a region downstream of the recording unit in the transport direction and upstream of the take-up unit in the transport direction.

Furthermore, in the foregoing recording apparatus, the plurality of rotating bodies may be three or more rotating bodies.

Still further, in the recording apparatus, the transport unit may be capable of transporting a medium having one length in the intersecting direction and a medium having another length in the intersecting direction that is different from the one length, and the rotating bodies may be movable in the intersecting direction, corresponding to the length of the medium in the intersecting direction.

Further, in the recording apparatus, a total length of the plurality of rotating bodies in the intersecting direction may be greater than or equal to a length of the medium in the intersecting direction.

The recording apparatus may further include a tensioner unit that is provided downstream of the recording unit in the transport direction and that contacts, at a contact portion, the medium over a length of the medium in the intersecting direction and that gives tension to the medium, and the rotating body may be provided at the contact portion.

The recording apparatus may further include a rotating body driving motor that drives the rotating body, and the control unit may control the rotating body driving motor.

The recording apparatus may further include a rotating body stoppage unit that gives load against rotation of the rotating body, and the control unit may control the rotating body stoppage unit.

According to a second aspect of the invention, there is provided a recording method for a recording apparatus that includes a transport unit capable of transporting a medium, a detection unit capable of detecting a transport direction in which the transport unit transports the medium, and a recording unit capable of performing recording on the medium transported by the transport unit. The recording method includes controlling, on the basis of a result of detection by the detection unit, rotation of each of a plurality of rotating bodies individually that are provided in an intersecting direction that intersects the transport direction and that are capable of contacting a side surface of the medium opposite to a recording surface of the medium on which recording is performed by the recording unit and that each have a rotation shaft that extends in the intersecting direction. The method also includes transporting the medium and performing recording on the medium.

According to the invention, the skew transport of a medium can be inhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, recording apparatuses according exemplary embodiments of the invention will be described with reference to the accompanying drawings.

Exemplary Embodiment 1 (FIG. 1 to FIG. 4C)

Figure 1:
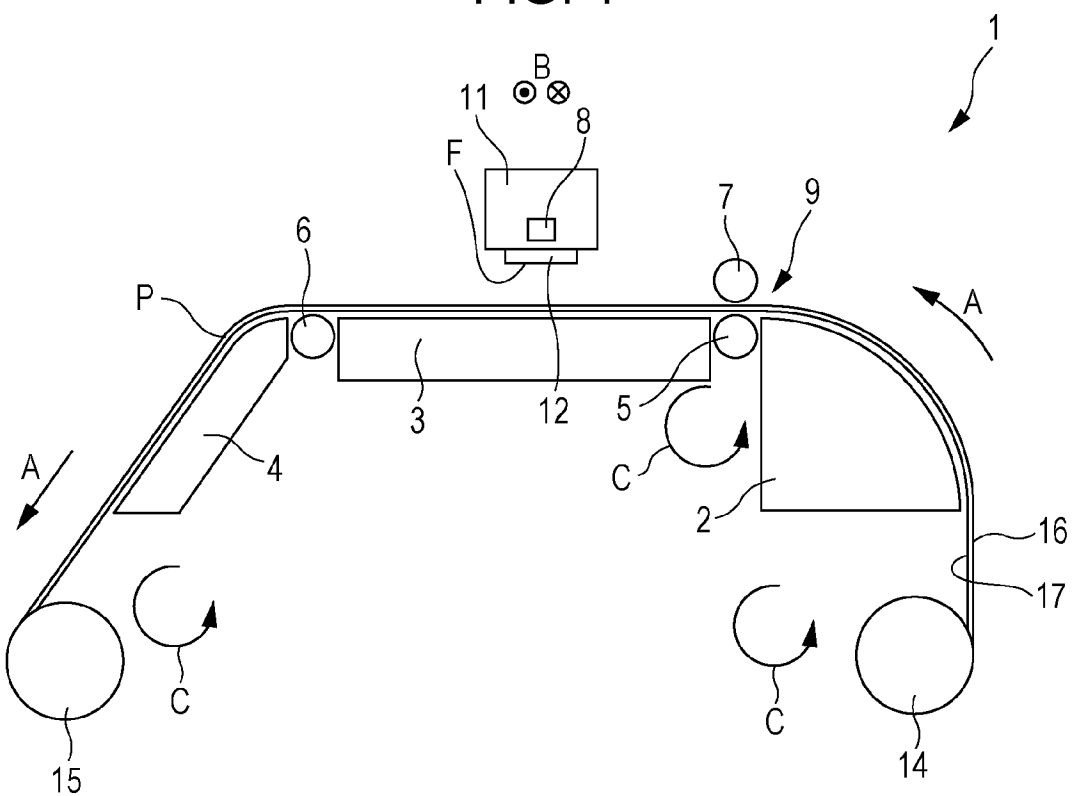
FIG. 1 is a schematic side view of a recording apparatus according to Exemplary Embodiment 1 of the invention.
Figure 2:
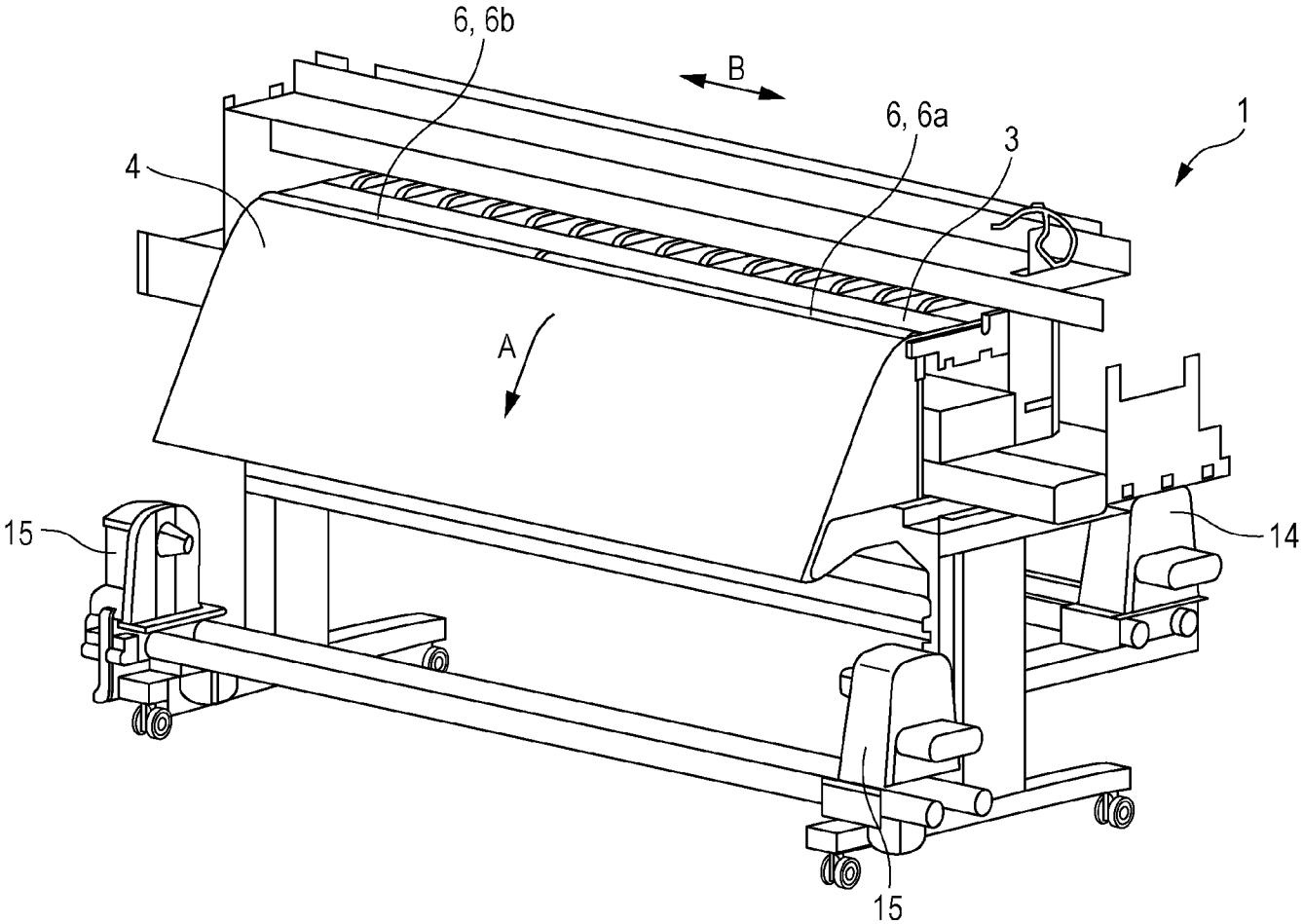
FIG. 2 is a schematic perspective view of the recording apparatus according to Exemplary Embodiment 1 of the invention.

FIG. 1 is a schematic side view of a recording apparatus 1 according to this exemplary embodiment. FIG. 2 is a schematic perspective view of the recording apparatus 1 of this exemplary embodiment. Note that in both FIG. 1 and FIG. 2, some of the component members of the recording apparatus 1, such as a casing portion, are omitted and, particularly in FIG. 2, a carriage 11 is omitted as well so as to facilitate visual recognition of rollers 6 provided as rotating bodies that are capable of adjusting the transport direction of a medium and that are functional elements of the exemplary embodiment.

As illustrated in FIG. 1, the recording apparatus 1 of this exemplary embodiment transports a recording medium P in a transport direction A from a medium setting unit 14 for a recording medium P (medium) to a take-up unit 15 for the recording medium P via a platen 2, a platen 3, and a platen 4 that are support portions for the recording medium P. That is, a transport path of the recording medium P in the recording apparatus 1 extends from the medium setting unit 14 to the take-up unit 15. The platen 2, the platen 3, and the platen 4 are support portions provided along the transport path so as to support the recording medium P. Note that the medium setting unit 14 feeds the recording medium P by rotating in a rotation direction C, and the take-up unit 15 takes up the recording medium P by rotating in the rotation direction C.

Incidentally, because this exemplary embodiment uses a roll type recording medium P that has been rolled so that a recording surface 16 of the recording medium P faces outward, a rotation shaft of the medium setting unit 14 is rotated in the rotation direction C to feed the recording medium P from the medium setting unit 14. In the case where a roll type recording medium P rolled so that the recording surface 16 faces inward is used, the rotation shaft of the medium setting unit 14 can be rotated in the direction opposite to the rotation direction C to feed the recording medium P.

In that case, too, the take-up unit 15 in this exemplary embodiment takes up the recording medium P so that the recording surface 16 of the recording medium P faces outward. To that end, a rotation shaft of the take-up unit 15 is rotated in the rotation direction C. On the other hand, in the case where the recording medium P is taken up so that the recording surface 16 faces inward, the rotation shaft of the take-up unit 15 can be rotated in the direction opposite to the rotation direction C to take up the recording medium P.

Incidentally, although the recording apparatus 1 of this exemplary embodiment is configured to be capable of performing recording on the rolled recording medium P, this configuration is not restrictive but the recording apparatus may be configured to be capable of performing recording on a cut sheet-shaped recording medium P. In the case where the recording apparatus is capable of performing recording on the cut sheet-shaped recording medium P, the medium setting unit 14 for the recording medium P may be, for example, a unit generally called sheet feeding (feeder) tray, sheet feeding (feeder) cassette, etc. Furthermore, a withdrawal unit for the recording medium P may also be a unit other than the take-up unit 15, for example, a unit generally called discharged medium receiver, discharged sheet (discharge) tray, discharged sheet (discharge) cassette, etc.

Furthermore, the recording apparatus 1 has, between the platen 2 and the platen 3, a rotation shaft that extends in intersecting directions B that intersect the transport direction A. That rotation shaft is provided with a driving roller 5 that gives a medium-sending force onto a surface 17 of the recording medium P that is a surface opposite to the recording surface 16.

A driven roller 7 having a rotation shaft that extends in the intersecting directions B is provided on the opposite side of the recording medium transport path to the driving roller 5. Thus, the driving roller 5 and the driven roller 7 forming a roller pair can clamp the recording medium P. Thus, the driving roller 5, the driven roller 7, etc. constitute a transport unit 9. Note that the driven roller means a roller that is driven as the recording medium P is transported.

Furthermore, when the recording medium P is transported in the transport direction A, the driving roller 5 is rotated in the rotation direction C and the driven roller 7 is rotated in the reverse direction opposite to the rotation direction C.

Furthermore, the recording apparatus 1 of this exemplary embodiment includes a recording head 12 as a recording unit at the opposite side of the transport path to the platen 3. The recording apparatus 1 forms a desired image by causing the recording head 12 to eject ink from a nozzle-formed surface F onto the recording medium P while moving the recording head 12 back and forth in the intersecting directions B by using a carriage 11. With this configuration, the recording head 12 is able to eject ink onto the recording medium P.

Incidentally, although the recording apparatus 1 of this exemplary embodiment includes the recording head 12 that performs recording while moving back and forth, a recording apparatus according the invention may be equipped with a so-called line head that includes a plurality of ink-ejecting nozzles arranged in the intersecting directions B that intersect the transport direction A.

Incidentally, the "line head" is a recording head in which a region of nozzles formed in the intersecting directions B that intersect the transport direction A of the recording medium P is provided so as to cover the entire length of the recording medium P in the intersecting directions B and which is for use in a recording apparatus that forms an image while relatively moving the recording head or the recording medium P. Incidentally, the region of nozzles of the line head extending in the intersecting directions B does not need to be able to entirely cover the lengths of all types of recording media P in the intersecting directions B which the recording apparatus is designed to handle.

Furthermore, although the recording head 12 of this exemplary embodiment is a recording unit capable of recording by ejecting ink in the form of liquid onto the recording medium P, the recording head in the invention is not limited to such a recording unit; for example, a transfer type recording unit that performs recording by transferring color materials to a recording medium P may also be used.

The carriage 11 is provided with a sensor 8 capable of detecting two opposite end portions of the recording medium P in the intersecting directions B.

Thus, since the carriage 11 as a mobile body that moves together with the recording head 12 in the intersecting directions B is provided with the sensor 8 as a detection unit capable of detecting the transport direction A in which the recording medium P is transported by the transport unit 9, the end portions of the recording medium P in the intersecting directions B can be easily detected. Therefore, the recording apparatus 1 of this exemplary embodiment is able to detect skew transport of the recording medium P without a need to detect a leading end portion or a tailing end portion of the recording medium P in the transport direction A. Hence, the recording apparatus 1 is configured to adjust the transport direction by using rollers 6 described below on the basis of the result of detection by the sensor 8 so that the skew transport of the recording medium P can be inhibited even when a continuous medium, such as the rolled recording medium P, is used as a recording medium.

Furthermore, the recording apparatus 1 of this exemplary embodiment includes, downstream of the recording head 12 in the transport direction A along the transport path of the recording medium P, the rollers 6 as rotating bodies that each have a rotation shaft in the intersecting directions B. As illustrated in FIG. 2, the rollers 6 include a plurality of rollers arranged in the intersecting directions B, for example, a roller 6*a* and a roller 6*b*. The rollers 6*a* and 6*b* are disposed at such positions as to be able to contact the surface 17 of the recording medium P opposite to the recording surface 16 on which recording is performed by the recording head 12.

The rollers 6*a* and 6*b* are both capable of being passively rotated as the recording medium P is transported in the transport direction A. The recording apparatus 1 of this exemplary embodiment is configured to be capable of stopping the rollers 6*a* and 6*b* separately from each other (i.e., stopping each roller individually) by a rotating body stoppage unit 18 (see FIG. 3).

Furthermore, the recording apparatus 1 of this exemplary embodiment includes a rotating body driving motor 22 (see FIG. 3) capable of driving each of the rollers 6*a* and 6*b* individually, so that the rollers 6*a* and 6*b* can be rotated in the rotation direction C corresponding to the transport speed of the recording medium P or so that rotation of each of the rollers 6*a* and 6*b* can be individually stopped or changed in speed or direction.

However, as long as the rotation of each of the rollers 6*a* and 6*b* can be controlled individually, the construction for controlling the rollers 6*a* and 6*b* is not particularly limited. For example, the construction for controlling the rollers 6*a* and 6*b* may a construction that includes only a mechanism capable of individually stopping each of the rollers 6*a* and 6*b* capable of being passively rotated as the recording medium P is transported (a construction that includes the rotating body stoppage unit 18 but does not include the rotating body driving motor 22) or a construction that includes only a mechanism that rotationally drives each of the rollers 6*a* and 6*b* individually (a construction that does not include the rotating body stoppage unit 18 but includes the rotating body driving motor 22). The rotating body stoppage unit 18 is a device that contacts a rotating body that is being passively rotated to give the rotating body a rotation-resisting load. For example, the rotating body stoppage unit 18 may have a construction that includes a member that contacts the rollers 6*a* and 6*b* to give friction force, a construction that contacts the rotation shafts of the rollers 6*a* and 6*b* to give friction force, or a construction that locks the rotation shafts of the rollers 6*a* and 6*b*.

Next, an electrical construction of the recording apparatus 1 of this exemplary embodiment will be described.

Figure 3:
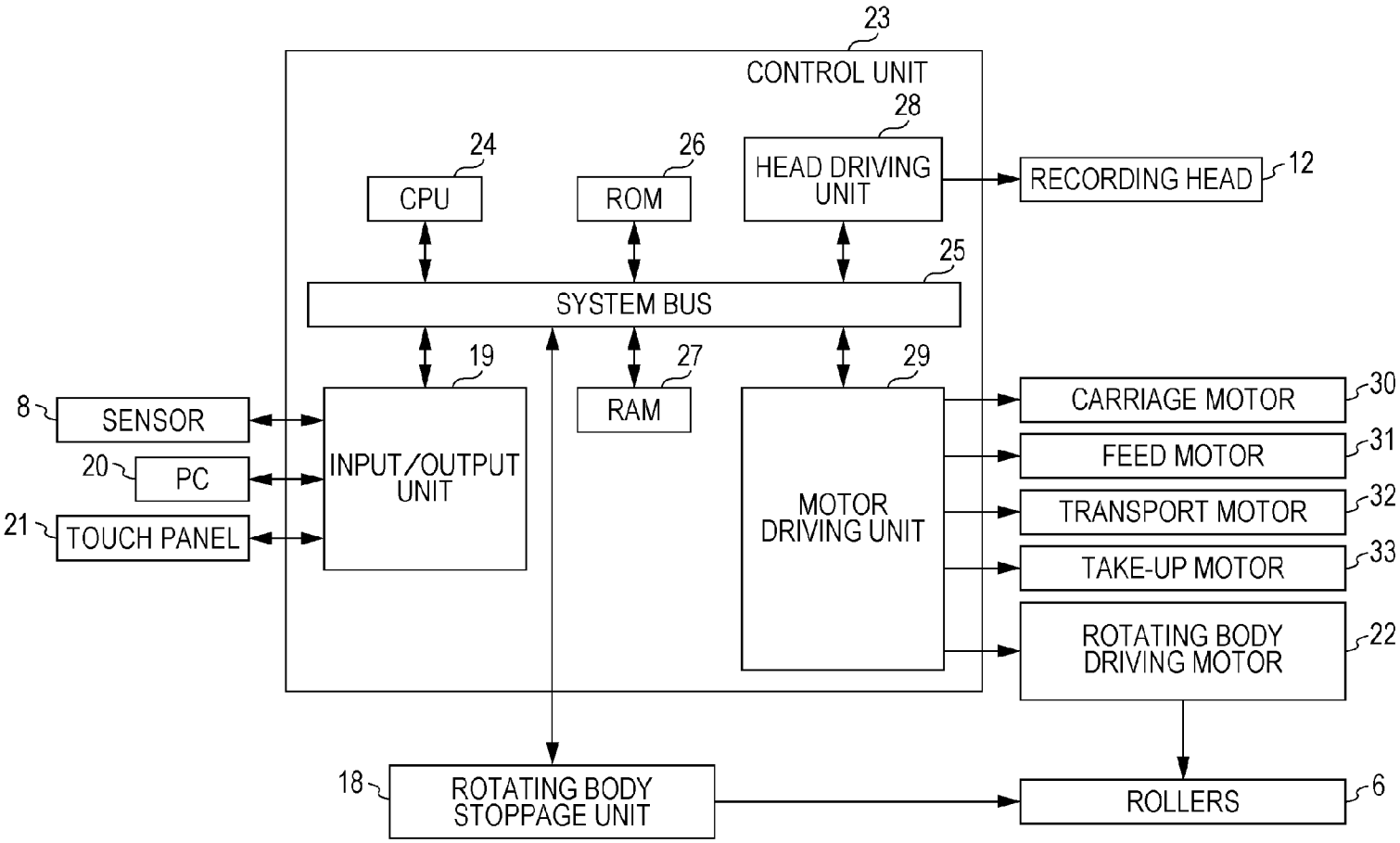
FIG. 3 is a block diagram of the recording apparatus according to Exemplary Embodiment 1 of the invention.

FIG. 3 is a block diagram of the recording apparatus 1 of this exemplary embodiment. A control unit 23 includes a CPU (central processing unit) 24 that performs overall control of the recording apparatus 1. The CPU 24 is connected, via a system bus 25, to a ROM (read-only memory) 26 in which various control programs that the CPU 24 executes are stored among others and a RAM (random access memory) 27 capable of temporarily storing data.

Furthermore, the CPU 24 is connected, via the system bus 25, to a head driving unit 28 that drives the recording head 12.

Furthermore, the CPU 24 is also connected, via the system bus 25, to a motor driving unit 29 that drives a carriage motor 30 for moving the carriage 11, a feed motor 31 that is a drive source of the medium setting unit 14, a transport motor 32 that is a drive source of the driving roller 5, a take-up motor 33 that is a drive source of the take-up unit 15, and a rotating body driving motor 22 capable of rotationally driving each of the rollers 6 (the rollers 6*a* and 6*b*) individually.

Furthermore, the CPU 24 is connected, via the system bus 25, to a rotating body stoppage unit 18 capable of stopping each of the rollers 6 (rollers 6*a* and 6*b*) individually from a passively rotated state.

Furthermore, the CPU 24 is connected, via the system bus 25, to an input/output portion 19. The input/output portion 19 is connected to the sensor 8, a PC (personal computer) 20 that is an external apparatus that inputs recording data or the like to the recording apparatus 1, and a touch panel 21 capable of accepting input of information by a user and displaying information regarding the recording apparatus 1.

Due to the foregoing construction, the control unit 23 of this exemplary embodiment is capable of giving different friction forces to the rollers 6*a* and 6*b* that are in contact with the surface 17 of the recording medium P opposite to the recording surface 16 thereof by controlling the rotation speed of each of the rollers 6*a* and 6*b* individually on the basis of results of detection by the sensor 8. Therefore, the recording apparatus 1 of this exemplary embodiment can inhibit the skew transport of the recording medium P without damaging the recording surface 16 of the recording medium P.

Incidentally, although the rollers 6 in this exemplary embodiment are provided between the platen 3 and the platen 4, there is no particular limitation regarding the locations at which the rollers 6 are provided.

Next, a specific rotation control of the rollers 6*a* and 6*b* performed by the control unit 23 at the time of occurrence of skew transport in the recording apparatus 1 of this exemplary embodiment.

Figure 4A:
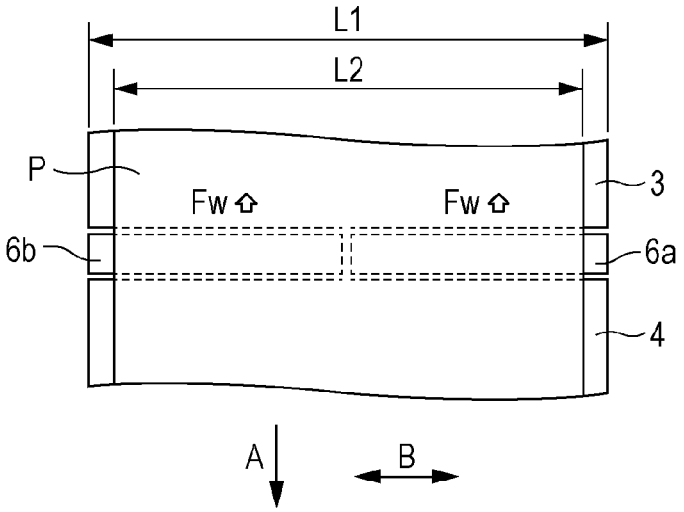
FIGS. 4A to 4C are schematic plan views of portions of the recording apparatus according to Exemplary Embodiment 1 of the invention.
Figure 4B:
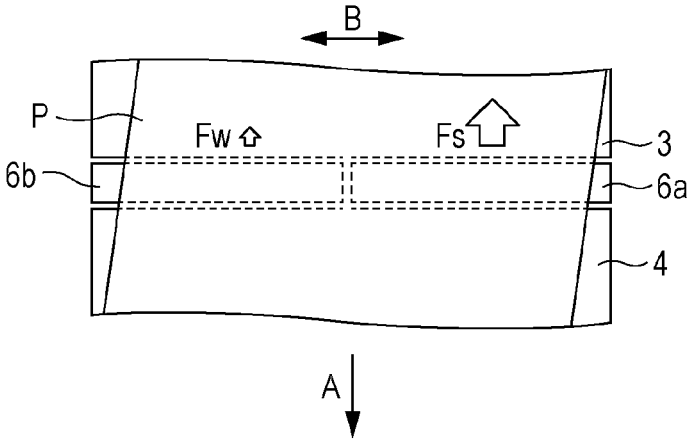
Figure 4C:
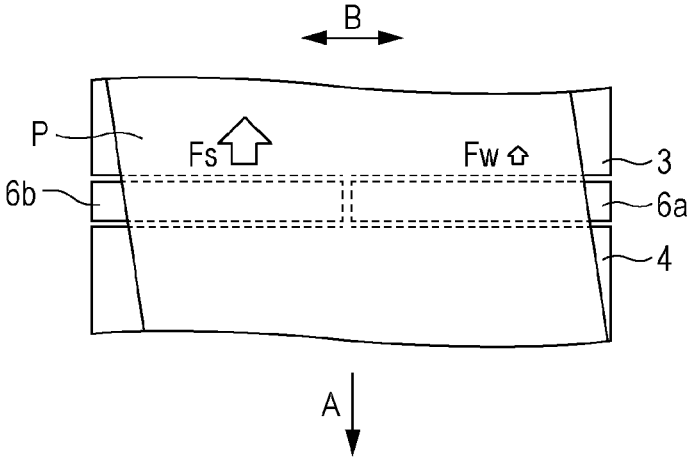

FIGS. 4A to 4C are schematic plan views of portions around the rollers 6*a* and 6*b*, which are functional portions of the recording apparatus 1 of this exemplary embodiment. FIG. 4A illustrates a state in which the recording apparatus 1 of this exemplary embodiment does not have skew transport. FIG. 4B illustrates a state in which the recording medium P is undergoing skew transport so as to deviate to a roller 6*b* side in the recording apparatus 1 of this exemplary embodiment as the recording medium P is transported downstream in the transport direction A. FIG. 4C illustrates a state in which the recoding medium P is undergoing skew transport so as to deviate to a roller 6*a* side in the recording apparatus 1 of this exemplary embodiment as the recording medium P is transported downstream in the transport direction A.

Incidentally, the recording apparatus 1 of this exemplary embodiment performs recording, due to control by the control unit 23, by alternately repeating a transport operation of transporting the recording medium P in the transport direction A and an ejection operation of stopping the transport operation and then ejecting ink from the recoding head 12 while moving the carriage 11 on which the recording head 12 is provided in the intersecting directions B. That is, the recording apparatus 1 of this exemplary embodiment forms an image while intermittently transporting the recording medium P, due to control by the control unit 23.

In this exemplary embodiment, the sensor 8 is provided on the carriage 11 and is capable detecting the end portions of the recording medium P in the intersecting directions B. Therefore, for the ejection operation, the sensor 8 is able to detect the end portions of the recording medium P before and after each transport operation. Hence, on the basis of the positions of the end portions detected before and after each transport operation, the control unit 23 is able to determine whether the recording medium P is undergoing a skew transport so as to deviate to the roller 6*a* side or is undergoing a skew transport so as to deviate to the roller 6*b* side.

Note that, as illustrated in FIG. 4A, when a skew transport is not occurring, the recording apparatus 1 of this exemplary embodiment is able to cause both the roller 6*a* and the roller 6*b* to be passively rotated corresponding to the movement of the recording medium P. Incidentally, during such a state, the friction force that the roller 6*a* exerts on the recording medium P in the direction opposite to the transport direction A is a weak friction force Fw and the friction force that the roller 6*b* exerts on the recording medium P in the direction opposite to the transport direction A is also the weak friction force Fw. Therefore, the friction forces exerted on the left and right sides of the recording medium P are equal in a view taken from the transport direction A, so that the state in which skew transport is not occurring is maintained.

Incidentally, as illustrated in FIG. 4A, the total length L1 of the rollers 6 (the rollers 6*a* and 6*b*) in the intersecting directions B in the recording apparatus 1 of this exemplary embodiment is greater than the length (width) L2 of the recording medium P in the intersecting directions B. Therefore, the rollers 6 are configured to be capable of firmly contacting the recording medium P substantially over the entire length of the recording medium P in the width direction and therefore effectively inhibiting the skew transport of the recording medium P.

Note that the "total length L1 of the rollers 6 in the intersecting directions B" is a length measured in the intersecting directions B from a one-side end of a one-side roller 6 (e.g., the roller 6*a*) of the plurality of rollers 6 in the intersecting directions B to an other-side end of an other-side roller 6 (e.g., the roller 6*b*) of the plurality of rollers 6 in the intersecting directions B.

On another hand, when the recording medium P is undergoing a skew transport so as to deviate to the roller 6*b* side as the recording medium P is transported downstream in the transport direction A as illustrated in FIG. 4B, the recording apparatus 1 of this exemplary embodiment is able to stop rotation of the roller 6*a* and allows the roller 6*b* to be passively rotated corresponding to the movement of the recording medium P. During such a state, the friction force that the roller 6*a* exerts on the recording medium P in the direction opposite to the transport direction A is a strong friction force Fs and the friction force that the roller 6*b* exerts on the recording medium P in the direction opposite to the transport direction A is the weak friction force Fw. Therefore, a roller 6*a*-side portion of the recording medium P in a view taken from the transport direction A receives a stronger drawing force acting to the upstream side than a roller 6*b*-side portion of the recording medium P. Due to such exertion of forces on the recording medium P, the transport operation transports the recording medium P by a greater transport amount at the roller 6*b* side than at the roller 6*a* side. Thus, the skew transport is corrected or inhibited.

Conversely, when the recording medium p is undergoing a skew transport so as to deviate to the roller 6*a* side as the recording medium P moves downstream in the transport direction A as illustrated in FIG. 4C, the recording apparatus 1 of this exemplary embodiment is able to stop rotation of the roller 6*b* and allows the roller 6*a* to be passively rotated corresponding to the movement of the recording medium P. During such a state, the friction force that the roller 6*a* exerts on the recording medium P in the direction opposite to the transport direction A is the weak friction force Fw and the friction force that the roller 6*b* exerts on the recording medium P in the direction opposite to the transport direction A is the strong friction force Fs. Therefore, the roller 6*b*-side portion of the recording medium P in a view taken from the transport direction A receives a stronger drawing force acting to the upstream side than the roller 6*a*-side portion of the recording medium P. Due to such exertion of forces on the recording medium P, the transport operation transports the recording medium P by a greater transport amount at the roller 6*a* side than at the roller 6*b* side. Thus, the skew transport is corrected or inhibited.

As mentioned above, the recording apparatus 1 of this exemplary embodiment has a construction in which the sensor 8 is provided on the carriage 11 on which the recoding head 12 is provided. However, this construction is not restrictive.

For example, the sensor 8 may be provided at the upstream side of the recording head 12 in the transport direction A. Such a construction allows a skew transport of the recording medium P to be detected prior to recording and therefore can effectively inhibit decline of the quality of images recorded on the recording medium P.

On another hand, in the construction that includes the take-up unit 15 capable of taking up the recording medium P is provided downstream of the recording head 12 in the transport direction A as in the recording apparatus 1 of this exemplary embodiment, the sensor 8 may be provided in a region downstream of the recording head 12 in the transport direction A and upstream of the take-up unit 15 in the transport direction A. Such a construction allows a skew transport to be effectively detected before the recording medium P is taken up and therefore can effectively inhibit no-good take-up of the recording medium P by the take-up unit 15, such as oblique take-up of the recording medium P.

Figure 5:
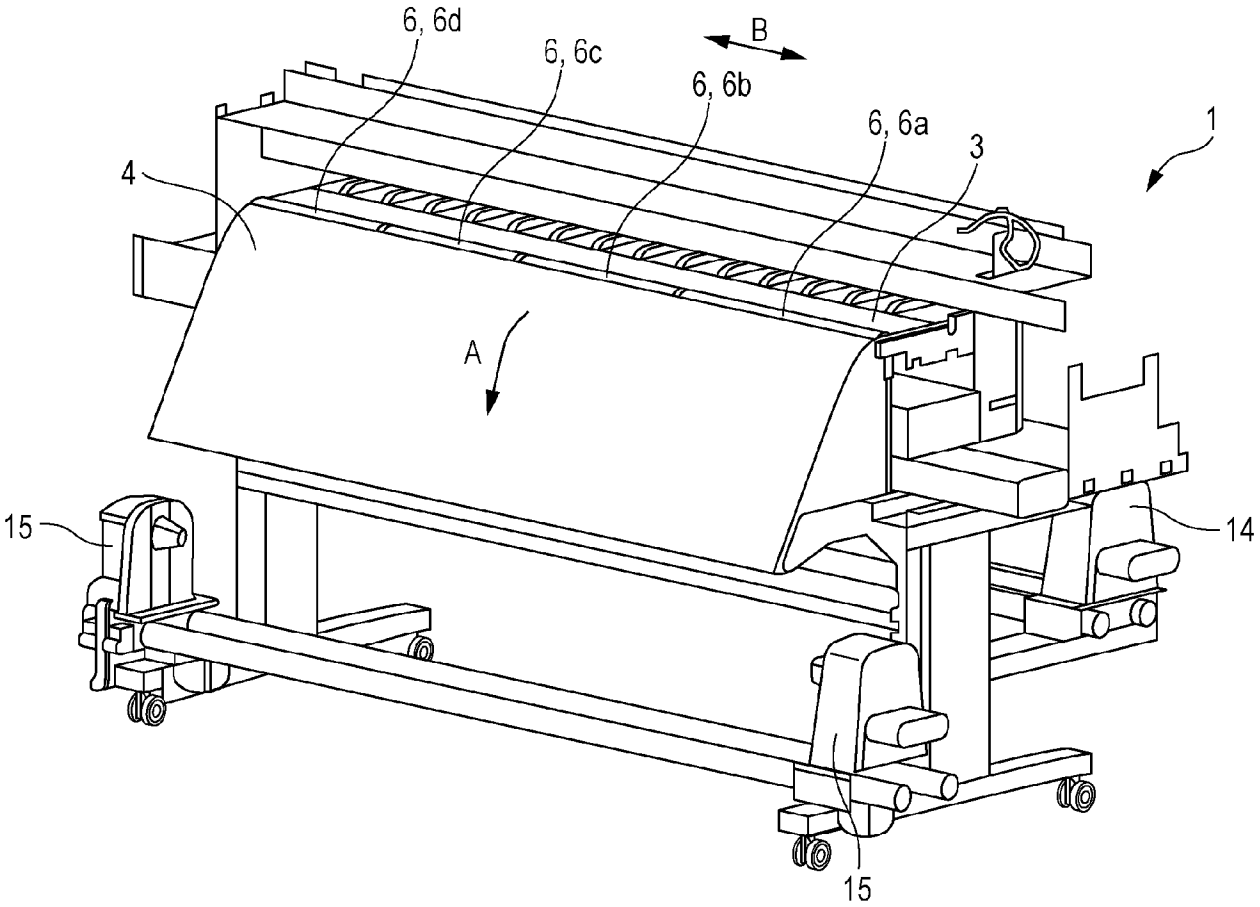
FIG. 5 is a schematic perspective view of a recording apparatus according to Exemplary Embodiment 2 of the invention.

Exemplary Embodiment 2 (FIG. 5)

Next, a recording apparatus according to Exemplary Embodiment 2 will be described in detail with reference to the drawings.

FIG. 5 is a schematic perspective view of a recording apparatus 1 according to this exemplary embodiment, corresponding to FIG. 2 illustrating the recording apparatus 1 of Exemplary Embodiment 1. Incidentally, component members comparable to those of Exemplary Embodiment 1 described above are denoted by the same reference characters and detailed descriptions thereof are omitted from the following description.

The recording apparatus 1 of this exemplary embodiment is substantially the same in construction as the recording apparatus 1 of Exemplary Embodiment 1, except for the construction of rollers 6.

The rollers 6 in Exemplary Embodiment 1 have a construction in which the two rollers 6*a* and 6*b* are aligned in the intersecting directions B.

The rollers 6 in this exemplary embodiment have a construction in which four rollers 6*a*, 6*b*, 6*c* and 6*d* are aligned in the intersecting directions B. The rollers 6*a*, 6*b*, 6*c* and 6*d* in this exemplary embodiment have substantially the same construction as the rollers 6*a* and 6*b* in Exemplary Embodiment 1, except that the length thereof in the intersecting directions B is different. In this exemplary embodiment, a control unit 23 is capable of rotationally driving and controlling each of the rollers 6*a*, 6*b*, 6*c* and 6*d* individually.

The recording apparatus 1 of this exemplary embodiment is capable of transporting various recording media P that vary in the length (width) in the intersecting directions B in the same manner as the recording apparatus of Exemplary Embodiment 1 but is different therefrom in that the rollers 6 in this exemplary embodiment are more finely divided so as to more precisely correspond to different widths of recording media P. Therefore, the skew transport of various recording media P that vary in width can be effectively inhibited.

The recording apparatus 1 of this exemplary embodiment includes four rollers 6, that is, the rollers 6*a*, 6*b*, 6*c* and 6*d*. Provision of three of more rollers 6 can inhibit the skew transport of recording media P of various widths more effectively that provision of two rollers 6.

Figure 6:
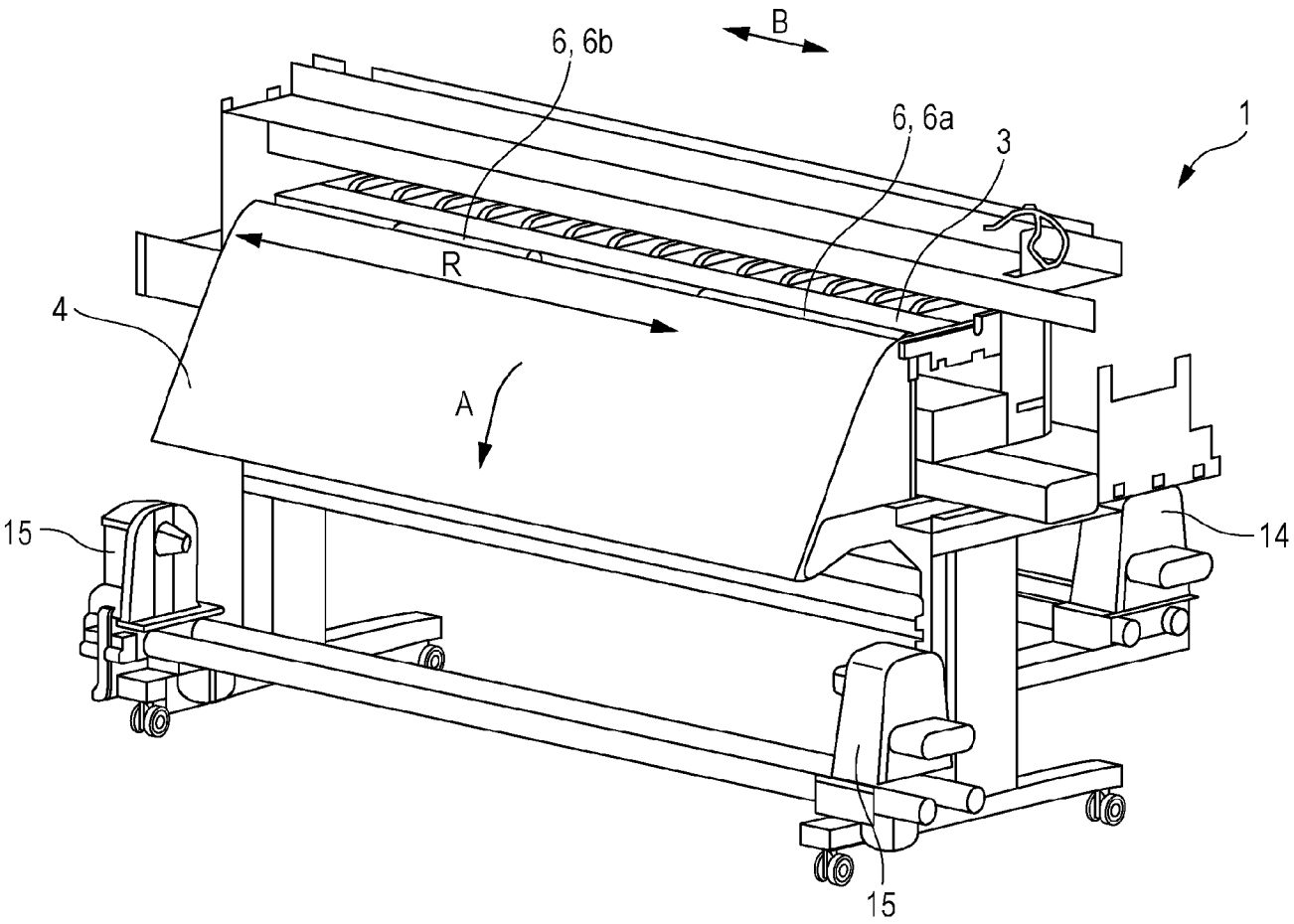
FIG. 6 is a schematic perspective view of a recording apparatus according to Exemplary Embodiment 3 of the invention.

Exemplary Embodiment 3 (FIG. 6)

Next, a recording apparatus according to Exemplary Embodiment 3 will be described with reference to the drawings.

FIG. 6 is a schematic perspective view of a recording apparatus 1 according to this exemplary embodiment, corresponding to FIG. 2 illustrating the recording apparatus 1 of Exemplary Embodiment 1. Incidentally, component members comparable to those of Exemplary Embodiments 1 and 2 described above are denoted by the same reference characters and detailed descriptions thereof are omitted from the following description.

The recording apparatus 1 of this exemplary embodiment is substantially the same in construction as the recording apparatus 1 of the Exemplary Embodiment 1, except for the construction of rollers 6.

The rollers 6 in Exemplary Embodiment 1 have a construction in which the two fixed type rollers, that is, the roller 6*a* and the roller 6*b*, are aligned in the intersecting directions B.

On the other hand, the rollers 6 in this exemplary embodiment have a construction in which a fixed type roller 6*a* and a roller 6*b* movable within a movement region R in the intersecting directions B are aligned in the intersecting directions B. The rollers 6*a* and 6*b* in this exemplary embodiment have substantially the same construction as the rollers 6*a* and 6*b* in Exemplary Embodiment 1, except that the length thereof in the intersecting directions B is different and the roller 6*b* in this exemplary embodiment is movable in the intersecting directions B. In this exemplary embodiment, a control unit 23 is capable of rotationally driving and controlling each of the rollers 6*a* and 6*b* individually.

Although the roller 6*b* in this exemplary embodiment can be manually moved in the intersecting directions B by a user according to the width of the recording medium P used, it is permissible to adopt a construction in which the roller 6*b* is automatically moved according to the width of the recording medium P used, by control performed by the control unit 23 or the like.

Furthermore, although in the recording apparatus 1 of this exemplary embodiment, only the roller 6*b* of the rollers 6*a* and 6*b* is movable in the intersecting directions B, both of the rollers 6*a* and 6*b* may be movable in the intersecting directions B.

The recording apparatus 1 of this exemplary embodiment is capable of transporting various recording media P that vary in the length (width) in the intersecting directions B in the same manner as the recording apparatus of Exemplary Embodiment 1 and, furthermore, is capable of moving the roller 6*b* in the intersecting directions B corresponding the width of the recording medium P. Therefore, the skew transport of recording media P of various widths can be effectively inhibited.

Figure 7:
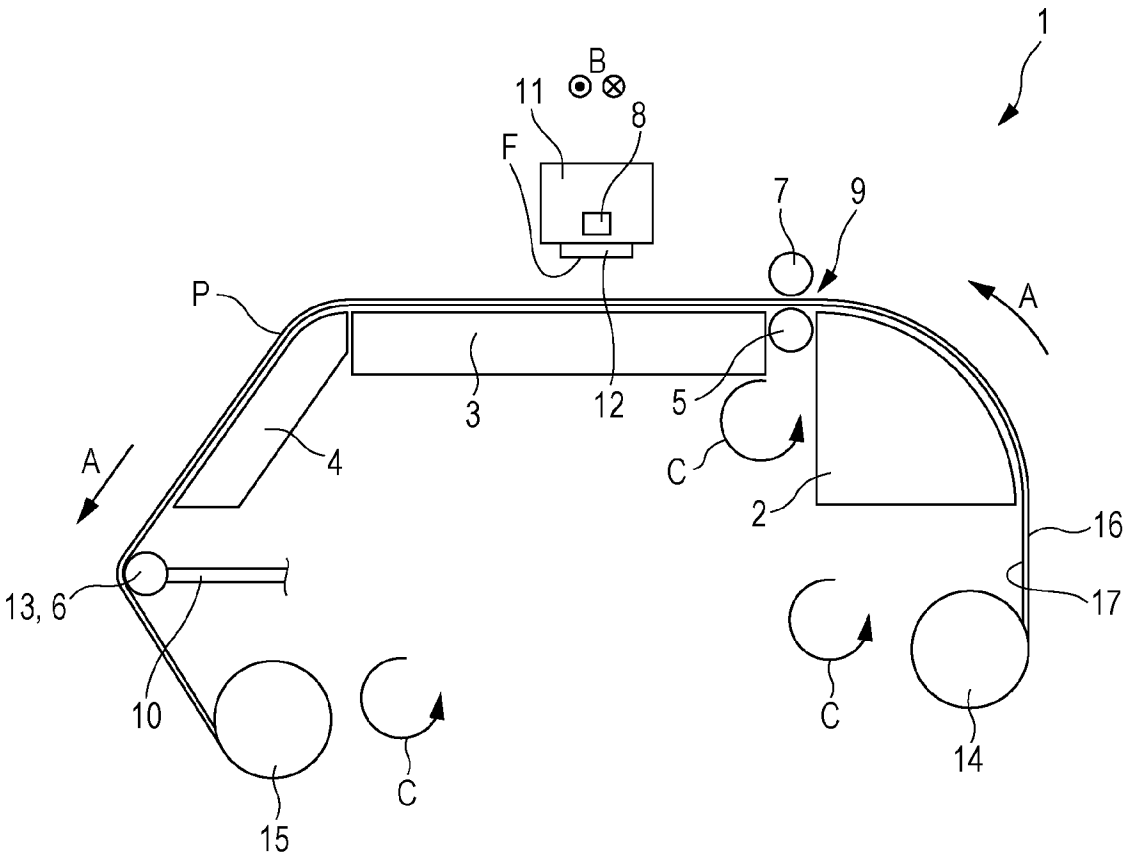
FIG. 7 is a schematic side view of a recording apparatus according to Exemplary Embodiment 4 of the invention.

Exemplary Embodiment 4 (FIG. 7)

Next, a recording apparatus according to Exemplary Embodiment 4 will be described with reference to the drawings.

FIG. 7 is a schematic side view of a recording apparatus 1 of this exemplary embodiment, corresponding to FIG. 1 illustrating the recording apparatus 1 of Exemplary Embodiment 1. Incidentally, component members comparable to those of Exemplary Embodiments 1 to 3 described above are denoted by the same reference characters and detailed descriptions thereof are omitted from the following description.

The recording apparatus 1 of this exemplary embodiment is substantially the same in construction as the recording apparatus 1 of Exemplary Embodiment 1, except that in the recording apparatus 1 of this exemplary embodiment, a tensioner unit 10 that applies tension to the recording medium P transported in the transport direction A is provided in order to improve the ease of take-up of the recording medium P on a take-up unit 15, and that rollers 6 are provided on the tensioner unit 10.

The rollers 6 in Exemplary Embodiment 1 are provided between the platen 3 and the platen 4.

On the other hand, the rollers 6 in this exemplary embodiment are provided at a contact portion 13 of the tensioner unit 10 that gives tension to the recording medium P transported in the transport direction A. The contact portion 13 can contact a surface 17 of the recording medium P over the width thereof in the intersecting directions B. The surface 17 is opposite to a recording surface 16 of the recording medium P. The rollers 6 in this exemplary embodiment, similar to the rollers 6 in Exemplary Embodiment 1, have a construction in which two fixed type rollers 6, that is, a roller 6*a* and a roller 6*b*, are aligned in the intersecting directions B.

In other words, the rollers 6 in this exemplary embodiment are provided on the tensioner unit 10 that is provided at the downstream side of the recording head 12 in the transport direction A and that contacts, at the contact portion 13 thereof, the recording medium P over the entire width of the recording medium P in the intersecting directions B; more specifically, the rollers 6 are provided at the contact portion 13 of the tensioner unit 10. Therefore, the tensioner unit 10 also serves a skew transport inhibiting function, so that it is not necessary to provide a separate rotating body, such as a roller 6, separately from the tensioner unit 10. Thus, the recording apparatus 1 is simplified in construction and reduced in cost.

Incidentally, the expression "contacts, at the contact portion 13 thereof, the recording medium P over the entire width of the recording medium P in the intersecting directions B" is meant to also cover the case where a portion of the recording medium P in the intersecting directions B is not in contact with any roller.

Figure 8A:
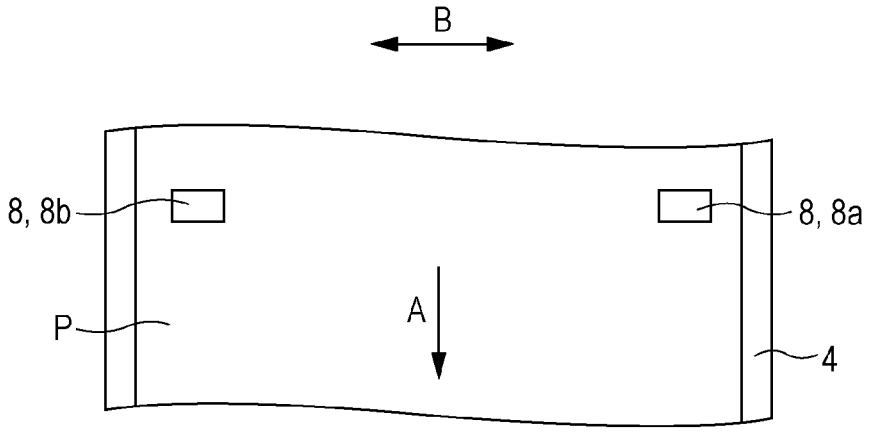
FIGS. 8A and 8B are schematic plan views of portions of a recording apparatus according to Exemplary Embodiment 5 of the invention.
Figure 8B:
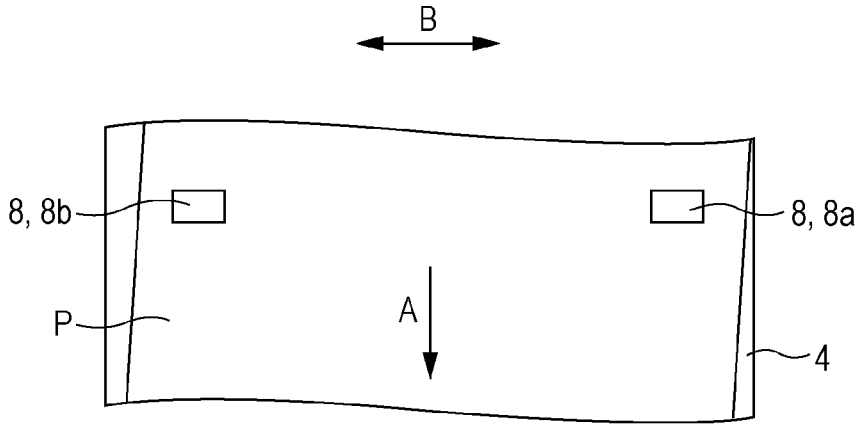

Exemplary Embodiment 5 (FIGS. 8A and 8B)

Next, a recording apparatus according to Exemplary Embodiment 5 will be described in detail with reference to the drawings.

FIGS. 8A and 8B are schematic plan views of the recording apparatus 1 of this exemplary embodiment. Incidentally, component members comparable to those of Exemplary Embodiments 1 to 4 described above are denoted by the same reference characters and detailed descriptions thereof are omitted from the following description.

The recording apparatus 1 of this exemplary embodiment is substantially the same in construction as the recording apparatus 1 of Exemplary Embodiment 1, except for the construction of a sensor 8.

FIGS. 8A and 8B are schematic plan views illustrating sensors 8 in the recording apparatus 1 of this exemplary embodiment which are different from the sensor used in the recording apparatus 1 of Exemplary Embodiment 1 and also illustrating portions around the sensors 8. FIG. 8A illustrates a state in which a recording medium P is transported without skewing. FIG. 8B illustrates a state in which the recording medium P is undergoing a transport so as to deviate to the left side in the drawing (to a sensor 8*b* side) as the recording medium P moves downstream in the transport direction A.

As illustrated in FIGS. 8A and 8B, the recording apparatus 1 of this exemplary embodiment includes, as sensors 8 that detect the transport speed of the recording medium P during transport, a sensor 8*a* termed first speed sensor as well and a sensor 8*b* termed second speed sensor as well that is provided at a location that is different from the location of the sensor 8*a* in intersecting directions B that intersect the transport direction A. Then, the control unit 23, as a skew detection unit, is capable of finding relative speed difference based on speeds detected by the sensor 8*a* and the sensor 8*b* and detecting a skew state of the recording medium P from the relative speed difference.

By finding the relative speed difference between different locations on the recording medium P in the intersecting directions B, for example, a left side and a right side on the recording medium P in a view from the transport direction A, and detecting the skew state (degree of skew) of the transported body from the relative speed difference as described above, it is possible to supplement a situation of incapability of highly accurately detecting the absolute speed of the recording medium P, for example, as in the case where speed sensors incapable of highly accurately detecting the absolute speed are used as the first and second speed sensors. Specifically, the accuracy of detection of the skew state of the recording medium P can be increased.

Even in the case where speed sensors incapable of highly accurately detecting the absolute speed are used as the first speed sensor and the second speed sensor, the incapability of highly detecting the absolute speed of the recording medium P can be supplemented by the foregoing arrangement for the following reason.

The control unit 23 computes the relative speed difference based on the detected speeds that are detected by the sensor 8*a* and the sensor 8*b* as follows.

In the recording apparatus 1 of this exemplary embodiment, the sensor 8*a* and the sensor 8*b* are provided so that the positions of the sensors 8*a* and 8*b* in the intersecting directions B can be changed. Therefore, a user can make an arrangement in which the distance from the right side end of the recording medium P to the sensor 8*a* in FIGS. 8A and 8B is substantially equal to the distance of the left side end of the recording medium P to the sensor 8*b*. In this arrangement of the sensor 8*a* and the sensor 8*b*, the transport speed Vave of the recording medium P as a whole is Vave=(V1+V2)/2 where V1 is the detected speed by the sensor 8*a* and V2 is the detected speed by the sensor 8*b*. The control unit 23 computes ((V1−V2)/Vave)×100(%) and determines this computed value as the relative speed difference.

Incidentally, although the control unit 23 in this exemplary embodiment determines ((V1−V2)/Vave)×100(%) as the relative speed difference, V1−V2 may be determined as the relative speed difference.

Since the skew state of the recording medium P is determined with reference to the relative speed difference, the construction as in the recording apparatus 1 of this exemplary embodiment achieves highly accurate detection of the skew state of the recording medium P even if a speed sensor incapable of highly accurately detecting the absolute speed of the recording medium P is used.

For example, if the skew state is determined on the basis of the absolute speeds of the recording medium P provided as the speed V1 detected by the sensor 8*a* and the speed V2 detected by the sensor 8*b*, the detected values of the absolute speeds may change depending on the kind of the recording medium P or the like, so that accurate determination of the skew state sometimes cannot be performed.

On the other hand, according to this exemplary embodiment, even when the detected speed V1 by the sensor 8*a* and the detected speed V2 by the sensor 8*b* change, the ratios of V1 and V2 to Vave do not change, so that the value of ((V1−V2)/Vave)×100(%) does not change. Therefore, the skew state can be accurately determined.

Note that even when the relative speed difference is constant, the state of transport of the recording medium P can change naturally according to the distance of the sensor 8*a* and the sensor 8*b*. Therefore, the skew state is determined on the basis of the distance of the sensor 8*a* and the sensor 8*b* as well.

In the related skew detection technologies including a technology of detecting the leading end of a recording medium P, effective detection of skew is difficult unless a skew detection sensor is disposed at a location at which the recording medium P is likely to greatly deviate due to skew of the recording medium P from the transport path. On the other hand, the recording apparatus 1 of this exemplary embodiment is configured to transport the continuous recording medium P from the medium setting unit 14 to the take-up unit 15 in a so-called roll-to-roll manner. Therefore, at any location along the transport path of the recording medium P, the degree of skew in the case of skew transport of the recording medium P is unlikely to greatly vary. Therefore, at all locations along the transport path of the recording medium P, the relative speed difference (degree of skew) tends to be substantially the same. Therefore, the degree of freedom regarding the locations of installation of the first speed sensor 8*a* and the second speed sensor 8*b* can be increased.

Furthermore, even in a construction in which the continuous recording medium P is not transported in the roll-to-roll manner, if the skew transport is determined on the basis of the relative speed difference of the recording medium P, highly accurate determination of the skew transport is made possible by disposing the sensors 8 at locations other than locations at which skew of the recording medium P accumulates. Therefore, in this exemplary embodiment, the degree of freedom regarding the installation locations of the sensors 8 can be increased in comparison with the constructions in which the skew state cannot be highly accurately determined unless the sensor is disposed at a location at which skew of the recording medium P accumulates, for example, a construction in which the skew state is determined by detecting the absolute speed of the recording medium P or a construction in which the skew state is determined by detecting the leading end of the recording medium P.

Incidentally, the sensor 8*a* and the sensor 8*b* in this exemplary embodiment are substantially the same in construction. However, speed sensors of different constructions may instead be used.

In the state illustrated in FIG. 8A, the transport speed of the recording medium P detected by the sensor 8*a* and the transport speed of the recording medium P detected by the sensor 8*b* do not have any difference from each other. Therefore, the control unit 23 determines that there is not any relative speed difference based on the speeds detected by the sensor 8*a* and the sensor 8*b*.

On the other hand, in the state illustrated in FIG. 8B, the transport speed of the recording medium P detected by the sensor 8*a* is greater than the transport speed of the recording medium P detected by the sensor 8*b*. Since the transport speed of the recording medium P detected by the sensor 8*a* is faster, the amount of transport is greater at the sensor 8*a* side than at the sensor 8*b* side, so that the recording medium P deviates to the sensor 8*b* side as the recording medium P moves downstream in the transport direction A. Therefore, the control unit 23 determines that there is a relative speed difference based on the speeds detected by the sensor 8*a* and the sensor 8*b* and that the transport speed is greater at the sensor 8*a* side in the intersecting directions B.

The sensor 8*a* and the sensor 8*b* in this exemplary embodiment each emit electromagnetic waves (light) to the recording medium P, receive electromagnetic waves reflected from the recording medium P, and find a transport speed of the recording medium P from a change in frequency due to the Doppler effect.

As for a speed sensor that finds the transport speed of a recording medium P from the change in frequency due to the Doppler effect, it sometimes happens that the detected speed value (value of the absolute speed) changes depending on different kinds of recording media P. There are cases where if the kind of recording medium P changes, the state of scattered light reflected from the recording medium P also changes. If such a speed sensor finds the skew state of the recording medium P by directly using the detected speed value, it sometimes becomes difficult to highly accurately detect the skew state of the recording medium P due to effect of difference in the kind of recording medium P.

On the other hand, the recording apparatus 1 of this exemplary embodiment finds a relative speed difference based on the detected speeds detected by the sensor 8*a* and the sensor 8*b* and detects the skew state of the recording medium P from the relative speed difference. Hence, the recording apparatus 1 is able to cancel out the amounts of change occurring in the detected speeds by the sensor 8*a* and the sensor 8*b* due to different kinds of recording media P and therefore can accurately detect the skew state.

Incidentally, although the sensor 8*a* and the sensor 8*b* in this exemplary embodiment are both configured to emit electromagnetic waves to the recording medium P and receives electromagnetic waves reflected from the recording medium P, the sensors may be configured to emit acoustic waves to the recording medium P and receive acoustic waves reflected from the recording medium P.

Preferred concrete examples of a speed sensor capable of finding the transport speed of the recording medium P from a change in frequency due to the Doppler effect will be described. A first preferred example is a configuration that emits two irradiation beams from the upstream side and the downstream side of the recording medium P in the transport direction A and receives reflected beams (scattered light) from the recording medium P based on the two irradiation beams by using one light reception portion. Each scattered beam contains information about the speed of the recording medium P in the transport direction A in the form of a change in wavelength. Specifically, the scattered beam resulting from the upstream-side irradiation beam increases in wavelength and the scattered beam resulting from the downstream-side irradiation beam decreases in wavelength. Therefore, the wavelength difference between the two scattered beams is detected by heterodyne detection in the form a wavelength from which the transport speed of the recording medium P can be determined.

Another preferred example of the speed sensor is a configuration in which irradiation light is emitted from a laser device to the recording medium P moving in the transport direction A and scattered light (returning light) from the recording medium P whose wavelength has changed from that of the irradiation light due to the reflection on the moving recording medium P is received by the laser device. If the returning light, when reaching the laser device, coincides in phase with the irradiation light, the output of the laser device slightly increases. Utilizing this phenomenon of increase, the transport speed of the recording medium P can be determined.

Note that the sensor 8*a* and the sensor 8*b* in this exemplary embodiment have the configuration of the first mentioned preferred example.

Furthermore, sensors different from the above-described sensors may also be used. Examples of the sensors different from the above-described sensors include a motion sensor that includes a plurality of light emission portions and one light reception portion. Using this motion sensor, an end portion of the recording medium P can be detected.

Figure 9:
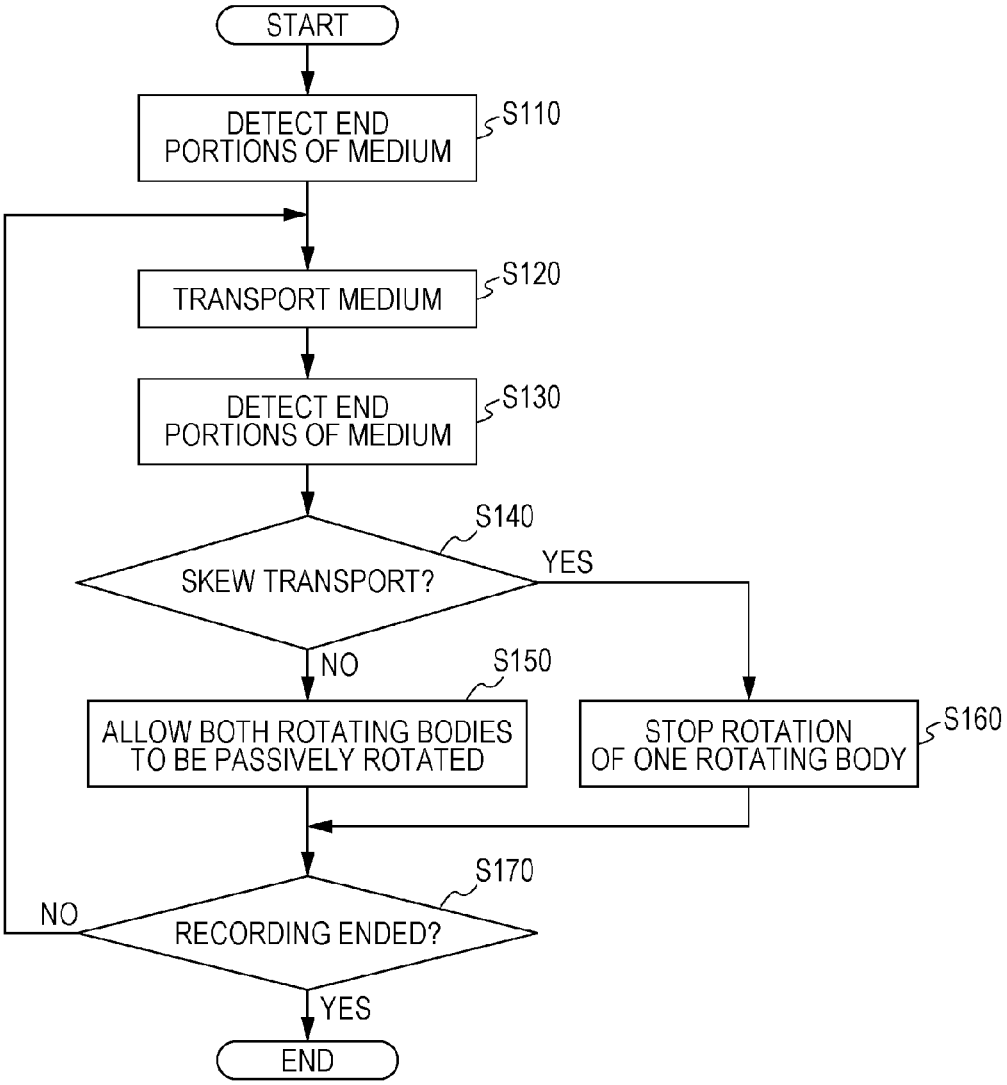
FIG. 9 is a flowchart of a recording method according to an exemplary embodiment of the invention.

Exemplary Embodiments of Recording Method (FIG. 9)

Next, a recording method according to an exemplary embodiment of the invention will be described with reference to FIG. 9.

Incidentally, the recording method of this exemplary embodiment is an exemplary embodiment of the recording method executed by using the recording apparatus 1 of Exemplary Embodiment 1, and is employed in the case where each of the rollers 6 is individually allowed to be passively rotated or stopped from rotating so as to adjust the transport direction. However, substantially the same recording method of the recording method of this exemplary embodiment can be executed by using the recording apparatus 1 of any one of Exemplary Embodiments 2 to 4 in substantially the same manner as the recording method of this exemplary embodiment.

When recording data is input from the PC 20, the recording apparatus 1 starts the recording method of this exemplary embodiment. First, in step S110, by control of the control unit 23, the positions of two opposite side end portions of the recording medium P in the intersecting directions B are detected by the sensors 8.

Next, in step S120, the recording medium P is transported to a predetermined location. Note that the transport of the recording medium P in this step corresponds to the transport of the recording medium P to a recording start location or the transport by one transport operation in an intermittent transport manner.

After the transport of the recording medium P in step S120 ends, the control unit 23 performs in step S130 a control such that the positions of the opposite side end portions of the recording medium P in the intersecting directions B are detected by the sensors 8.

Next, in step S140, the control unit 23 determines whether the recording medium P is undergoing a skew transport on the basis of detection results of the positions of the two opposite side end portions of the recording medium P in the intersecting directions B provided by the sensors 8 before and after the transport of the recording medium P in step S120.

If in step S140 it is determined that the recording medium P is not undergoing a skew transport, the process proceeds to step S150. If in step S140 it is determined that the recording medium P is undergoing a skew transport, the process proceeds to step S160.

In step S150, the control unit 23 performs a control such that the two rotating bodies, that is, the rollers 6*a* and 6*b*, are passively rotated as the recording medium P is transported.

On the other hand, in step S160, the control unit 23 controls the rotating body stoppage unit 18 so as to stop rotation of one of the rotating bodies, that is, one of the rollers 6*a* and 6*b*, and performs a control such that the other rotating body is passively rotated as the recording medium P is transported.

More specifically, if the recording medium P is undergoing a skew transport so as to deviate to the roller 6*a* side while moving downstream in the transport direction A, the recording apparatus 1 of this exemplary embodiment stops rotation of the roller 6*b* and allows the roller 6*a* to be passively rotated corresponding to the movement of the recording medium P. On the other hand, if the recording medium P is undergoing a skew transport so as to deviate to the roller 6*b* side while moving downstream in the transport direction A, the recording apparatus 1 of this exemplary embodiment stops rotation of the roller 6*a* and allows the roller 6*b* to be passive rotated corresponding to the movement of the recording medium P.

Then, after step S150 or step S160, the control unit 23, in step S170, performs recording based on the recording data input from the PC 20 and determines whether the recording based on the recording data has ended.

If in this step it is determined that the recording has ended, the control unit 23 ends the recording method of this exemplary embodiment. On the other hand, if in this step it is determined that the recording has not ended, the control unit 23 returns to step S120 and repeats the process of steps S120 to S170.

By individually controlling the rotation of each of the plurality of rollers, that is, the rollers 6*a* and 6*b*, which are arranged in the intersecting directions B and capable of contacting the surface 17 of the recording medium P opposite to the recording surface 16 thereof on the basis of results of detection by the sensors 8 so that the recording medium P can be appropriately transported and recording can be appropriately performed on the recording medium P as in the foregoing recording method of this exemplary embodiment, it is possible to perform appropriate recording by inhibiting the skew transport of the recording medium P without damaging the recording surface 16 of the recording medium P.

Incidentally, the invention is not limited to the foregoing exemplary embodiments but can be modified and changed in various manners within the scope of the invention described in the appended claims, and such modifications and changes are, of course, encompassed within the scope of the invention.

The invention has been described in detail above on the basis of concrete exemplary embodiments. The invention will be recapitulated below.

A recording apparatus 1 of a first exemplary embodiment of the invention includes a transport unit 9 capable of transporting a medium P, a detection unit 8 capable of detecting a transport direction A in which the transport unit 9 transports the medium P, a recording unit 12 capable of performing recording on the medium P transported by the transport unit 9, and a plurality of rotating bodies 6 provided in an intersecting direction B that intersects the transport direction A. Each rotating body 6 is capable of contacting a side surface 17 of the medium P opposite to a recording surface 16 of the medium P on which recording is performed by the recording unit 12 and has a rotation shaft that extends in the intersecting direction B. The recording apparatus 1 also includes a control unit 23 that controls rotation speed of each rotating body 6 individually on the basis of a result of detection by the detection unit 8.

According to this exemplary embodiment, the plurality of rotating bodies 6 are provided in the intersecting directions B and are capable of contacting the surface 17 of the medium P opposite to the recording surface 16 of the medium P, and the control unit 23 controls the rotation speed of each rotating body 6 individually on the basis of the result of detection by the detection unit 8. Therefore, the skew transport of the medium P can be inhibited without damaging the recording surface 16 of the medium P.

Note that the expression "capable of detecting the transport direction A" means that, for example, the detection unit can detect the transport direction A as a result of detecting the positions of end portions of the medium P in the intersecting direction B that intersects the transport direction A or detecting the transport speed of the medium P.

According to a second exemplary embodiment of the invention based on the first exemplary embodiment, the recording apparatus 1 further includes a mobile body 11 that moves in the intersecting direction B together with the recording unit 12 and the detection unit 8 is provided on the mobile body 11.

In the recording apparatus 1 according to this exemplary embodiment, the detection unit 8 is provided on the mobile body 11 that moves in the intersecting directions B together with the recording unit 12. Therefore, since the detection unit 8 can easily detect the end portions of the medium P in the intersecting directions B, the skew transport of the medium P can be inhibited even in the case where the recording apparatus 1 uses as the medium P a continuous medium such as a rolled medium P. The detection unit 8 is, for example, a sensor that includes a light emitter portion and a light receiver portion and that detects the end portion of the medium P by the light emitter portion emitting light to the medium and the light receiver portion receiving light reflected from the medium P.

In the recording apparatus 1 according to a third exemplary embodiment of the invention based on the first or second exemplary embodiment, the detection unit 8 is provided upstream of the recording unit 12 in the transport direction A.

In the recording apparatus 1 of this exemplary embodiment, the detection unit 8 is provided upstream of the recording unit 12 in the transport direction A. Therefore, the skew transport can be detected before recording is performed, so that decline of the quality of the image recorded on the medium P can be effectively inhibited.

According to a fourth exemplary embodiment of the invention based on the first or second exemplary embodiment, the recording apparatus 1 further includes a take-up unit 15 provided downstream of the recording unit 12 in the transport direction A and being capable of taking up the medium P, and the detection unit 8 is provided in a region downstream of the recording unit 12 in the transport direction A and upstream of the take-up unit 15 in the transport direction A.

In the recording apparatus 1 of this exemplary embodiment, the detection unit 8 is provided in the region downstream of the recording unit 12 in the transport direction A and upstream of the take-up unit 15 in the transport direction A. Therefore, the skew transport of the medium P can be effectively detected before the medium P is taken up, so that no-good take-up of the medium P, such as oblique take-up of the medium P, can be effectively inhibited.

In the recording apparatus 1 according to a fifth exemplary embodiment of the invention based on any one of the first to fourth exemplary embodiments, the number of the rotating bodies 6 provided is three or greater.

In the recording apparatus 1 of this exemplary embodiment, three or more rotating bodies 6 are provided. Therefore, it becomes possible to highly precisely handle various media P according the length (width) thereof in the intersecting directions B, so that the skew transport can be effectively inhibited with regard to various media P having different widths.

In the recording apparatus 1 according to a sixth exemplary embodiment of the invention based on any one of the first to fifth exemplary embodiments, the transport unit 9 is capable of transporting a medium P having one length in the intersecting direction B and a medium P having another length in the intersecting direction B that is different from the one length, and the rotating bodies 6 are movable in the intersecting direction B, corresponding to the length of the medium P in the intersecting direction B.

In the recording apparatus 1 of this exemplary embodiment, the rotating bodies 6 are movable in the intersecting directions B, corresponding to the length (width) of the medium in the intersecting directions B. Therefore, the skew transport can be effectively inhibited with regard to various media P having different widths.

In the recording apparatus 1 according to a seventh exemplary embodiment of the invention based on any one of the first to sixth exemplary embodiments, a total length of the plurality of rotating bodies 6 in the intersecting direction B may be greater than or equal to a length of the medium P in the intersecting direction B.

Note that the "total length of the rotating bodies 6 in the intersecting direction B" means a length measured in the intersecting direction B from a one-side end of a one-side rotating body 6*a* of the plurality of rotating bodies 6 in the intersecting direction B to an other-side end of an other-side rotating body 6*b* of the plurality of rotating bodies 6 in the intersecting direction B.

According to this exemplary embodiment, the total length of the rotating bodies 6 in the intersecting directions B is greater than or equal to the length of the medium P in the intersecting directions B. Therefore, the rotating bodies 6 can firmly contact the medium P over the length thereof in the width direction thereof, so that the skew transport of the medium P can be effectively inhibited.

According an eighth exemplary embodiment of the invention based on any one of the first to seventh exemplary embodiments, the recording apparatus 1 further includes a tensioner unit 10 that is provided downstream of the recording unit 12 in the transport direction A and that contacts, at a contact portion 13, the medium P over a length of the medium P in the intersecting direction B and that gives tension to the medium P, and the rotating body 6 is provided at the contact portion 13.

In the recording apparatus 1 of this exemplary embodiment, the rotating bodies 6 are provided at the contact portion 13 of the tensioner unit 10 that is provided downstream of the recording unit 12 in the transport direction A and that contacts at the contact portion 13 the medium P over the length of the medium P in the intersecting directions B and that gives tension to the medium P of the tensioner unit 10. Therefore, providing the tensioner unit 10 so as to perform the skew transport inhibiting function as well will omit providing a rotating body 6 separately from the tensioner unit 10.

Note that the foregoing expression "contacts at the contact portion 13 the medium P over the length of the medium P in the intersecting directions B" is meant to also cover the case where a portion of the recording medium P in the intersecting directions B is not in contact with any roller.

According to a ninth exemplary embodiment of the invention based on any one of the first to eighth exemplary embodiments, the recording apparatus further includes a rotating body driving motor that drives the rotating body, and the control unit controls the rotating body driving motor.

In the recording apparatus of this exemplary embodiment, the rotation speed of each rotating body 6 can be individually controlled more easily by controlling the rotating body driving motor.

According to a tenth exemplary embodiment of the invention based on any one of the first to ninth exemplary embodiments, the recording apparatus further includes a rotating body stoppage unit that gives load against rotation of the rotating body, and the control unit controls the rotating body stoppage unit.

In the recording apparatus of this exemplary embodiment, the rotation speed of each rotating body 6 can be individually controlled more easily by controlling the rotating body stoppage unit.

A recording method according to an eleventh exemplary embodiment of the invention is a recording method for a recording apparatus 1 that includes a transport unit 9 capable of transporting a medium P, a detection unit 8 capable of detecting a transport direction A in which the transport unit 9 transports the medium P, and a recording unit 12 capable of performing recording on the medium P transported by the transport unit 9. The recording method includes controlling, on the basis of a result of detection by the detection unit 8, rotation of each of a plurality of rotating bodies 6 individually that are provided in an intersecting direction B that intersects the transport direction A and that are capable of contacting a side surface 17 of the medium P opposite to a recording surface 16 of the medium P on which recording is performed by the recording unit 12 and that each have a rotation shaft that extends in the intersecting direction B. The method also includes transporting the medium P and performing recording on the medium P.

In the recording method of this exemplary embodiment, the rotation of each of the rotating bodies 6 provided in the intersecting directions B and being capable of contacting the surface 17 of the medium P opposite to the recording surface 16 of the medium P is controlled separately from one rotating body 6 to another on the basis of the result of detection by the detection unit 8, and the medium P is transported and recording is performed on the medium P. Therefore, it is possible to perform recording on the medium P while inhibiting the skew transport of the medium P without damaging the recording surface 16 of the medium P.

This application claims priority under 35 U.S.C. § 119 to Japanese Patent Application No. 2014-250615, filed Dec. 11 2014. The entire disclosure of Japanese Patent Application No. 2014-250615 is hereby incorporated herein by reference.

What is claimed is:

1. A recording apparatus comprising:

a transport unit capable of transporting a medium;

a detection unit capable of detecting a transport direction in which the transport unit transports the medium;

a recording unit capable of performing recording on the medium transported by the transport unit, the recording unit comprising a head that ejects liquid from nozzles onto the medium;

a plurality of rotating bodies disposed downstream of the recording unit and being provided in an intersecting direction that intersects the transport direction, each rotating body being configured to passively rotate from movement of the medium transported along the rotating body and being capable of contacting a side surface of the medium opposite to a recording surface of the medium on which recording is performed by the recording unit and having a rotation shaft that extends in the intersecting direction; and a control unit that controls rotation speed of each rotating body individually on the basis of a result of detection by the detection unit, wherein the detection unit is provided upstream of the recording unit in the transport direction.

2. The recording apparatus according to claim 1, wherein the plurality of rotating bodies are three or more rotating bodies.

3. The recording apparatus according to claim 1, wherein:

the transport unit is capable of transporting a medium having one length in the intersecting direction and a medium having another length in the intersecting direction that is different from the one length; and the rotating bodies are movable in the intersecting direction, corresponding to the length of the medium in the intersecting direction.

4. The recording apparatus according claim 1, wherein a total length of the plurality of rotating bodies in the intersecting direction is greater than or equal to a length of the medium in the intersecting direction.

5. The recording apparatus according to claim 1, further comprising a tensioner unit that is provided downstream of the recording unit in the transport direction and that contacts, at a contact portion, the medium over a length of the medium in the intersecting direction and that gives tension to the medium, wherein the rotating body is provided at the contact portion.

6. The recording apparatus according to claim 1, further comprising a rotating body driving motor that drives the plurality of rotating bodies, wherein the control unit controls the rotating body driving motor.

7. The recording apparatus according to claim 1, further comprising a brake that gives load against rotation of the rotating body, wherein the control unit controls the brake.

8. A recording method for a recording apparatus that includes a transport unit capable of transporting a medium, a detection unit capable of detecting a transport direction in which the transport unit transports the medium, and a recording unit capable of performing recording on the medium transported by the transport unit, the recording unit comprising a head that ejects liquid from nozzles onto the medium, wherein the detection unit is provided upstream of the recording unit in the transport direction, the recording method comprising:

controlling, on an individual basis and on the basis of a result of detection by the detection unit, rotation of each of a plurality of rotating bodies disposed downstream of the recording unit and that are provided in an intersecting direction that intersects the transport direction and that are capable of contacting a side surface of the medium opposite to a recording surface of the medium on which recording is performed by the recording unit and that each have a rotation shaft that extends in the intersecting direction, each rotating body passively rotating from movement of the medium transported along the rotating body until rotation is controlled on the basis of the result of detection by the detection unit;

transporting the medium; and performing recording on the medium.

* * * * *